US006495810B2

(12) United States Patent
Takagi et al.

(10) Patent No.: US 6,495,810 B2
(45) Date of Patent: Dec. 17, 2002

(54) FIXING DEVICE USING INDUCTION HEATING AS A HEATING SOURCE

(75) Inventors: Osamu Takagi, Tokyo (JP); Satoshi Kinouchi, Tokyo (JP); Kazuhiko Kikuchi, Yokohama (JP); Hisaaki Kawano, Chigasaki (JP); Hiroshi Nakayama, Kawasaki (JP); Kenji Takano, Tokyo (JP); Taizo Kimoto, Tokyo (JP); Noriyuki Umezawa, Yokohama (JP); Masahiko Ogura, Yokohama (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/939,728

(22) Filed: Aug. 28, 2001

(65) Prior Publication Data

US 2002/0030050 A1 Mar. 14, 2002

Related U.S. Application Data

(63) Continuation of application No. PCT/JP99/07412, filed on Dec. 28, 1999.

(51) Int. Cl.[7] ..... H05B 6/14; H05B 6/06

(52) U.S. Cl. ..... 219/619; 219/667; 219/676; 399/330

(58) Field of Search ..... 219/619, 670, 219/672, 676, 667; 399/328, 329, 330, 336

(56) References Cited

U.S. PATENT DOCUMENTS

| | | | | |
|---|---|---|---|---|
| 3,686,460 A | * | 8/1972 | Lamparter et al. | 219/619 |
| 5,752,150 A | | 5/1998 | Kato et al. | 399/330 |
| 5,822,669 A | | 10/1998 | Okabayashi et al. | 399/330 |
| 6,255,632 B1 | | 7/2001 | Yokoyama et al. | 219/619 |

FOREIGN PATENT DOCUMENTS

| | | |
|---|---|---|
| JP | 10-123861 | 5/1998 |
| JP | 10-161446 | 6/1998 |
| JP | 11-30924 | 2/1999 |

* cited by examiner

*Primary Examiner*—Philip H. Leung
(74) *Attorney, Agent, or Firm*—Foley & Lardner

(57) ABSTRACT

A fixing device comprising an endless heating member which is adapted to be contacted with a fixable member to thereby enable an image on the fixable member to be thermally fixed, an electromagnetic inductive coil member disposed close to the endless heating member and inductively heating the endless heating member, and an AC power supply circuit supplying an AC current to the electromagnetic inductive coil member. The coil member is constructed such that in a state where the coil member is positioned in the fixing device, a ratio between an inductance L of the coil member and a load resistance R of the coil member meets a condition of $L/R<50\times10^{-6}$ (H/Ω).

17 Claims, 4 Drawing Sheets

FIXING DEVICE USING INDUCTION HEATING AS A HEATING SOURCE

CROSS REFERENCE TO RELATED APPLICATIONS

This is a Continuation Application of PCT Application No. PCT/JP99/07412, filed Dec. 28, 1999, which was not published under PCT Article 21 (2) in English.

BACKGROUND OF THE INVENTION

1. Field of the Invention

The present invention relates to the fixing device for an image-forming device, and in particular, to the fixing device for an electrophotographic apparatus where induction heating is employed as a heating source.

2. Description of the Related Art

According to the conventional fixing device of an electrophotographic apparatus, the fixing is generally performed as follows. Namely, a halogen lamp is employed as a heating source, wherein the halogen lamp is disposed inside a metal roller to heat the roller, and an elastic roller is pressed onto the metal roller, thereby press-contacting a fixable material (a material to be fixed) onto the metal roller. These rollers are then rotated and the fixable material is passed through an interface between these rollers. Alternatively, a method of heating the roller in a non-contact manner by making use of a flash lamp is also put to practical use.

According to the conventional fixing device of this system however, since the heating roller is heated by making use of a lamp, the heat efficiency thereof is at most about 70%. Additionally, since the heating roller is constructed such that it is heated from the inside thereof, the heating roller is accompanied with various problems that the temperature-rise characteristic is poor, that the structure thereof is rather complicated, and that it is difficult to miniaturize the heating roller.

With a view to improve the efficiency of the fixing device, there have been proposed a fixing device which is designed to be heated through the utilization of induction heating, wherein an exciting coil is disposed inside the heating roller, and high-frequency current is applied to the exciting coil to thereby heat the heating roller through the generation of eddy currents in the heating roller.

In the case of the fixing device utilizing the induction heating as mentioned above, it is desired that a stable and effective heating thereof is required to be achieved. However, there still remain various problems that should be sufficiently studied, particularly with respect to the kinds of parameters that must be taken into account as well as with respect to the kinds of apparatus to be employed for that purpose.

Additionally, it is generally required, in order to obtain a predetermined quantity of heat, to employ a transformer for amplifying the current to be fed to the exciting coil. However, the employment of such a transformer would lead to an increase in the manufacturing cost of the fixing device.

Further, it is stipulated by regulations that the magnitude of the electric field leak should be controlled to be not more than a prescribed value for the sake of safety. Therefore, it is now required to find out parameters to meet the stipulated regulations.

Therefore, it is an object of the present invention to provide a fixing device which makes it possible to perform a stable and effective heating, which can be cheaply manufactured, and which is capable of easily meeting the requirement stipulated by regulations with regard to the magnitude of the electric field leak.

BRIEF SUMMARY OF THE INVENTION

According to the pre sent invention, there is provided a fixing device comprising an endless heating member which is adapted to be contacted with a fixable member to thereby enable an image on the fixable member to be thermally fixed; an electromagnetic inductive coil member disposed close to the endless heating member and inductively heating the endless heating member; and an AC power supply circuit supplying an AC current to the electromagnetic inductive coil member; wherein the coil member is constructed such that in a state where the coil member is positioned in the fixing device, a ratio between an inductance L of the coil member and a load resistance R of the coil member meets a condition of: $L/R<50\times10^{-6}$ (H/Ω).

According to the present invention, there is provided a fixing device comprising an endless heating member which is adapted to be contacted with a fixable member to thereby enable an image on the fixable member to be thermally fixed; an electromagnetic inductive coil member disposed close to the endless heating member and inductively heating the endless heating member; and an inverter driving circuit supplying an AC current to the electromagnetic inductive coil member; wherein the coil member is constructed such that in a state where the coil member is positioned in the fixing device, a ratio between an inductance L of the coil member and a load resistance R of the coil member meets a formula of: $L/R<50\times10^{-6}$ (H/Ω), and the inductance L and the load resistance R meet a formula of: $V^2/[(2\pi fL)^2+R^2]^{-1/2}>600$ under conditions where a supply voltage of the inverter driving circuit is in the range of 100 to 250V, and a frequency thereof is in the range of 20 to 50 kHz.

It is preferable in this fixing device that the coil member is constructed such that an electric current I which is represented by a formula of: $I=(V/R)(1-e^{-1/f/L/R})$ meets a withstanding current of the switching element of the inverter driving circuit under the conditions where a supply voltage of the inverter driving circuit is in the range of 100 to 250V, and a frequency thereof is in the range of 20 to 50 kHz.

The fixing device which is constructed as described above may be provided with the following specific features.

1. The thickness of the endless heating member is in the range of 0.1 to 10 mm.

2. The endless heating member is cylindrical having a diameter ranging from 20 to 60 mm.

3. A gap between the endless heating member and the coil member is in the range of 1 to 4 mm.

4. The frequency of the AC current is in the range of 20 to 50 kHz.

5. The material comprised in the endless heating member has a relative magnetic permeability of not more than 200.

6. The material comprised in the endless heating member is selected from the group consisting of iron, stainless steel, aluminum and a composite material comprising stainless steal and aluminum.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Various embodiments of the present invention will be explained in detail with reference to the drawings as follows.

Before discussing the fixing device embodying the present invention, the general features of a digital copying machine having a fixing device embodying the present invention will be explained.

Figure 1:
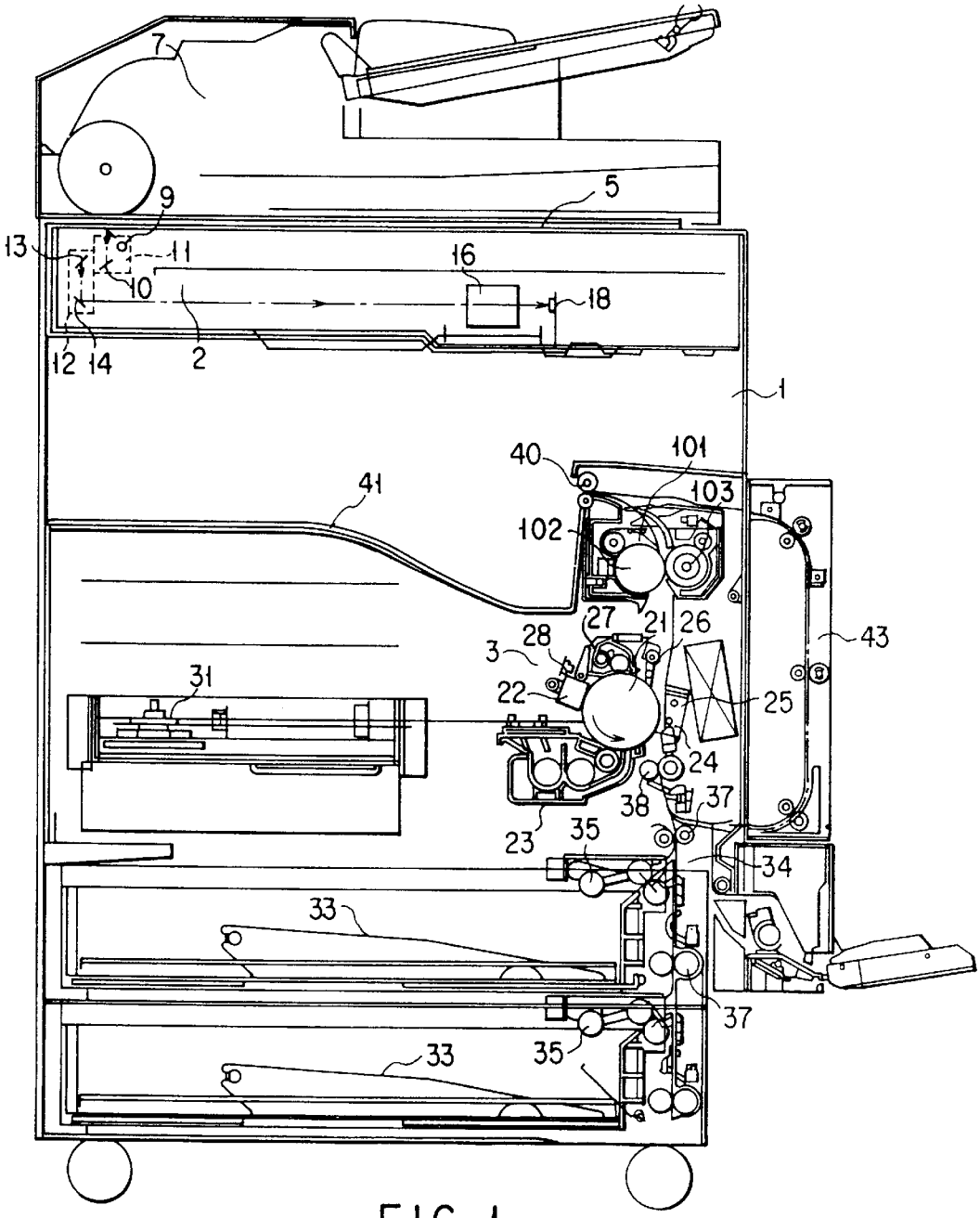
FIG. 1 shows the schematic view of a digital copying machine which is provided with a fixing device embodying the present invention.

FIG. 1 shows the entire structure of the digital copying machine which comprises a main body 1. In this main body 1, there are disposed a scanner 2 functioning as a scanning means to be explained hereinafter, and an image-forming unit 3 functioning as an image-forming means.

On the top surface of the main body 1, there is disposed an original-mounting board 5 which is made of a transparent glass and on which an original is to be mounted. Furthermore, on the top surface of the main body 1, there is also disposed an automatic document feeder 7 (hereinafter referred to as an ADF) which is designed to automatically feed an original (document) onto the original-mounting board 5.

The scanner 2 disposed inside the main body 1 is provided with a light source 9 such as a fluorescent lamp for illuminating the original placed on the original-mounting board 5 and also with a first mirror 10 for deflecting a light reflected from the original to a predetermined direction. These light source 9 and first mirror 10 are attached to a first carriage 11 disposed below the original-mounting board 5. Further, below the original-mounting board 5, there is disposed a second carriage 12 which is movable in a direction parallel with the original-mounting board 5. To this second carriage 12 are attached a second mirror 13 and a third mirror 14 which are directed orthogonal to each other so as to successively deviate the light reflected from the original and deviated by the first mirror 10. This second carriage 12 is enabled to move following the movement of the first carriage 11 in such a manner that it moves parallel with the original-mounting board 5 at half a speed of the first carriage 11.

Further, below the original-mounting board 5, there are disposed an imaging lens 16 for focusing the reflected light from the third mirror 14 mounted on the second carriage 12, and a light-receiving sensor 18 for receiving the reflected light that has been focused by the imaging lens 16.

On the other hand, the image-forming unit 3 is provided with a photosensitive drum 21 which is rotatably disposed on one inner intermediate sidewall portion of the main body 1. Along the outer peripheral wall of the photosensitive drum 21, there are sequentially arranged, as mentioned in the rotational direction thereof, an electrification charger 22, a developing device 23, a transfer charger 24, a releasing charger 25, a releasing claw 26, a cleaner 27 and a static eliminator 28.

On the opposite inner intermediate sidewall portion of the main body 1, there is rotatably disposed a polygon mirror 31 which is designed to scan an information-bearing light onto the photosensitive drum 21, the information-bearing light bearing image information that has been received by the light-receiving sensor 18.

At the bottom portion of the main body 1, a cassette 33 is displaceably introduced therein, and a number of sheets of copying paper are placed in the cassette 33. A pick-up roller 35 is disposed over one side of the cassette 33, thereby enabling the copying paper to be individually picked up one by one. Additionally, the main body 1 is provide therein with a conveying passageway 34 which extends upward from the cassette 33 and beyond a transferring unit portion interposed between the photosensitive drum 21 and the transfer charger 24. In the course of this conveying passageway 34, there are disposed a conveying roller pair 37 which is designed to hold and convey a sheet of copying paper that has been fed from the cassette 33 and an alignment roller pair 38 which is designed to adjust the position of each sheet of copying paper that has been fed from the conveying roller pair 37.

On a downstream side of the transferring unit portion in a conveying passageway 58, there are disposed a fixing device 101 for fixing a transcribed image that has been transferred to the copying paper, and a paper delivery roller pair 40. A copy receiving tray 41 for receiving the delivered copying paper is disposed on the paper delivery side of the delivery roller pair 40.

Incidentally, on one outer sidewall of the main body 1, there is disposed an automatic double face 43 which is designed to reverse the copying paper that has been passed through a fixing device 101 and to transfer the copying paper again to the image transferring unit.

Next, the image-forming operation by the aforementioned digital copying machine shown in FIG. 1 will be explained.

The original placed on the original-mounting board 5 is subjected to an exposure by means of the scanner 2. The light reflected from the original due to this exposure is allowed to pass through the first, second and third mirrors 10, 13 and 14, and through the image-forming lens 16, and then, received by the light-receiving sensor 18, in which an image information is read out. This image information is photoelectrically converted into an information-bearing light so as to be transmitted to the polygon mirror 31. Then, this information-bearing light is scanned onto the photosensitive drum 21 through the rotation of the polygon mirror 31.

By means of the electrification charger 22, the surface of the photosensitive drum 21 is uniformly charged, and then, through the scanning of the information-bearing light, an electrostatic latent image which corresponds to the image on the original is formed on the surface of the photosensitive drum 21. This electrostatic latent image is then conveyed through the rotation of the photosensitive drum 21 to the developing device 23, from which toner is fed onto the electrostatic latent image to thereby form a toner image.

On the other hand, concurrently, the copying paper is picked up one by one from the cassette 33 by means of the pick-up roller 35 and conveyed to the conveying passageway 34. Thereafter, the copying paper is conveyed by means of the conveying roller pair 37 to the alignment roller pair 38 to thereby adjust the position of the forward end of copying paper before it is further conveyed to the image transfer unit. In this image transfer unit, the toner image on the photosensitive drum 21 is transferred to the surface of copying paper P by the action of the transfer charger 24.

The copying paper having the toner image transferred thereto is released, through the actions of the releasing charger 25 and the releasing claw 26, from the outer peripheral surface of the photosensitive drum 44, and then, conveyed to the fixing device 101 of the present invention. The copying paper is then heated in this fixing device 101, and at the same time, subjected to pressing so as to fuse and fix the toner image onto the copying paper P. The copying paper having the toner image fixed thereto is delivered via the delivery roller pair 40 onto the copy receiving tray 41.

Figure 2:
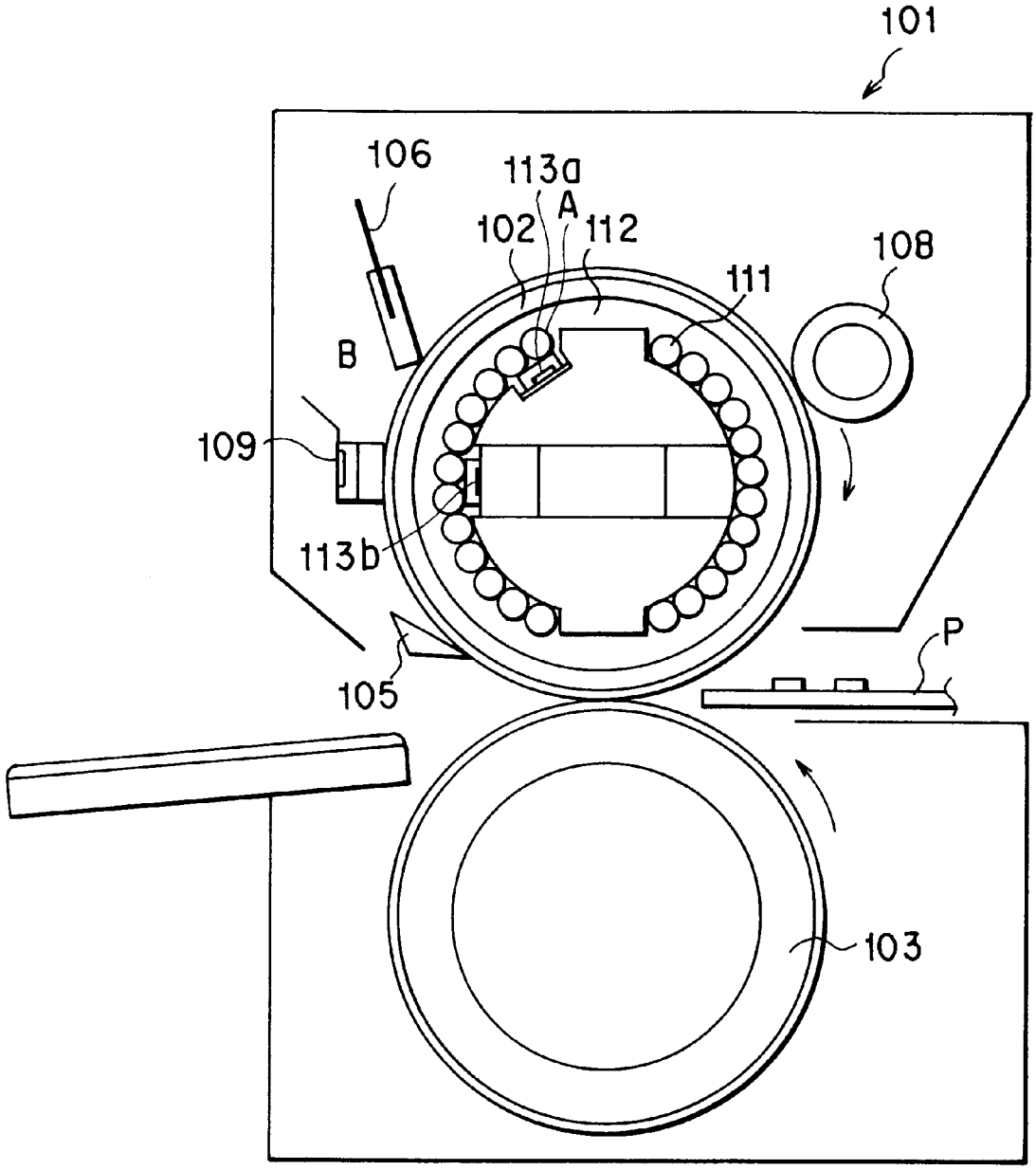
FIG. 2 is a cross-sectional view illustrating the entire structure of the fixing device according to one embodiment of the present invention.

FIG. 2 shows a cross-sectional view illustrating the entire structure of the fixing device according to one embodiment of the present invention. While FIG. 3 shows a perspective view illustrating the entire structure of the fixing device according to one embodiment of the present invention.

Figure 3:
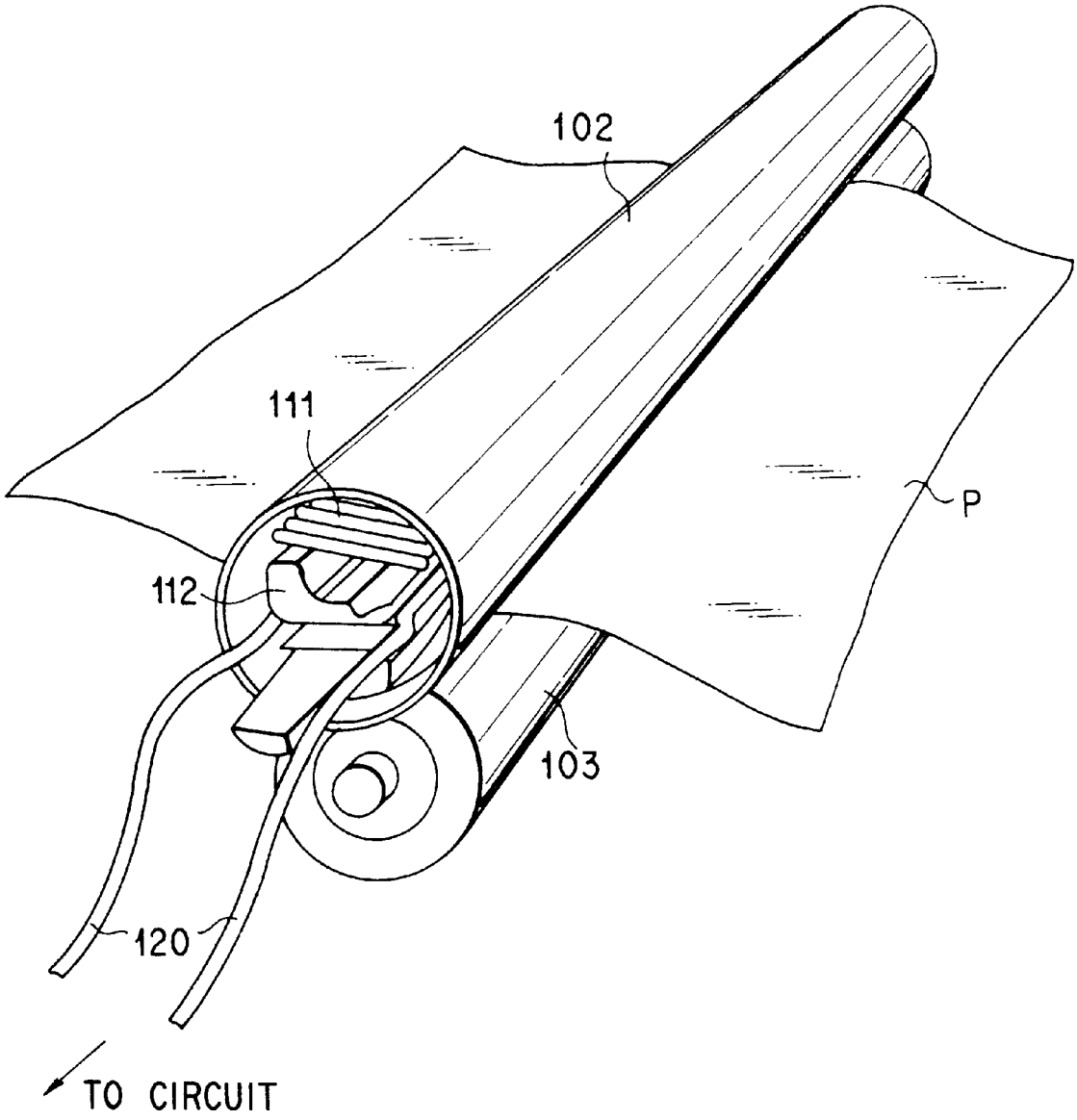
FIG. 3 is a perspective view illustrating the entire structure of the fixing device according to one embodiment of the present invention.

Referring to FIGS. 2 and 3, the fixing device 101 comprises a heat roller 102 having a diameter of 40 mm, and a press roller 103 having a diameter of 40 mm. Incidentally, in FIGS. 2 and 3, the heat roller 102 and the press roller 103 both constituting the fixing device 101 are vertically arranged for the convenience of explanation. As a matter of fact however, they are arranged horizontally in this embodiment as shown in FIG. 1.

This press roller 103 is press-contacted with the heat roller 102 by means of a pressing means (not shown), and a predetermined nip width is secured between these rollers 102 and 103. The heat roller 102 is designed to be driven in the direction indicated by the arrow by means of a driving motor (not shown), while the press roller 103 is designed to be moved following the movement of the heat roller 102 and rotates in the direction indicated by the arrow.

The heat roller 102 is made of iron and has a thickness of 1 mm. The surface of the heat roller 102 is covered with a release layer formed of a fluoroplastic (for example, Teflon: trademark). Incidentally, although the heat roller 102 is formed of iron in this embodiment, any other material can be employed for the heat roller 102 as long as it is capable of being heated through the generation of an eddy current by way of electromagnetic induction. For example, the heat roller 102 may be formed of stainless steel, aluminum, or a composite material comprising stainless steal and aluminum.

The press roller 103 comprises a core bar, the peripheral surface of which is covered with silicone rubber, fluororubber, etc.

As a copy paper P is passed through a fixing point or a press-contacted portion (nip portion) between the heat roller 102 and the press roller 103, the developing agent placed on the copy paper P can be fusion-bonded or press-bonded, thereby fixing the developing agent onto the copy paper P.

Along the outer peripheral wall of the heat roller 102, there are sequentially arranged, on the rotational downstream side of the contacting portion (nip portion) between the heat roller 102 and the press roller 103, a releasing claw 105 for releasing the copy paper P from the heat roller 102, a cleaner 106 for removing the developing agent or refuse such as waste pieces of paper that have been offset on the surface of the heat roller 102, a releasing agent-coating device 108 for coating an offset-preventing releasing agent, and a thermistor 109 for detecting the temperature of the heat roller 102.

In the fixing device constructed as mentioned above, induction heating means (magnetic field-generating means) is employed as a heating means for the heat roller 102. This induction heating means comprises an exciting coil 111 and disposed inside the heat roller 102. This exciting coil 111 comprises a litz wire formed of a bundle of copper wires insulated from each other and each having a diameter of 0.5 mm. By making use of this litz wire, the wire diameter can be made smaller than the penetrating depth of the electric current, thereby making it possible to effectively pass AC current therethrough.

According to this embodiment, the litz wire is formed of a bundle of sixteen copper wires each having a diameter of 0.5 mm. The copper wire constituting the litz wire is covered with an insulating layer formed of polyimide which is a heat-resistant resin.

This exciting coil 111 is not provided with a core material (for example, ferrite, iron core, etc.) which is designed to concentrate the magnetic flux of coil, but is provided with a core-less coil. Incidentally, this exciting coil 111 is supported by a coil-supporting member 112 formed of a heat-resistant resin (in this embodiment, heat-resistant engineering plastic). This coil-supporting member 112 is positioned in place by means of sheet metal (not shown) supporting the heat roller 102. As for the heat-resistant engineering plastics, it is possible to employ PPS (polyethylene sulfide), polyester imide, PFA, unsaturated polyester, heat-resistant phenol, polyimide, etc.

When a core-less coil is employed as the exciting coil 111, it would be no longer required to employ a core bar which is complicated in configuration, thereby making it possible to reduce the manufacturing cost of the fixing device. Moreover, it becomes also possible to reduce the manufacturing cost of the exciting circuit for applying a high-frequency current to the exciting coil 111.

When a high-frequency current is applied from the aforementioned exciting circuit (inverter circuit) via a lead wire 120 to the exciting coil 111, a magnetic flux is caused to be generated from the exciting coil 111, thereby enabling a magnetic flux and eddy currents to be generated in the heat roller 102 in a manner to prevent this magnetic field from being fluctuated. When eddy currents are caused to generated in the heat roller 102, Joule heat is caused to generate due to the resistance of the heat roller 102, thereby heating the heat roller 102. In this embodiment, a high-frequency current was applied from the inverter circuit to the exciting coil 111 under the conditions of 25 kHz in frequency and 900 W in output.

Figure 4:
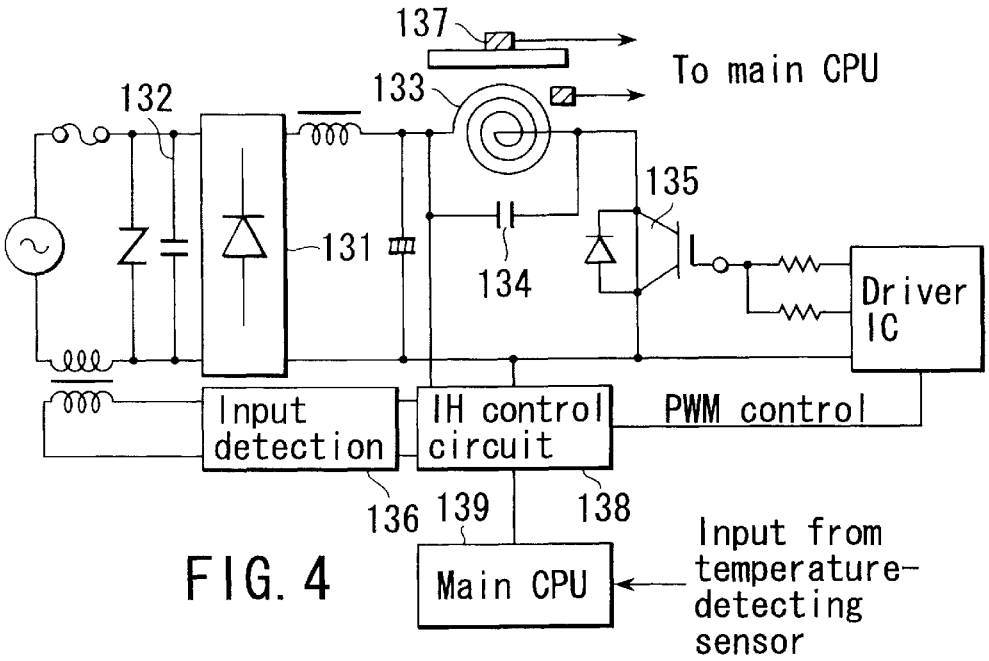
FIG. 4 is a block diagram illustrating the control system of the fixing device according to one embodiment of the present invention.

FIG. 4 shows a block diagram illustrating the control system of the fixing device according to one embodiment of the present invention which has been explained above with reference to FIGS. 2 and 3.

As shown in FIG. 4, the AC current of commercial power source 130 is rectified by way of a rectification circuit 131 and a smooth capacitor 132, and a high-frequency current is designed to be fed to the coil 133 by way of an inverter circuit including a resonance capacitor 134 and a switching circuit 135.

This high-frequency current is detected by input-detecting means 136 to thereby control it to a designated output. Specifically, this designated output can be controlled by making the ON time of the switching element variable through the control of PWM. On this occasion, the driving frequency is also caused to vary.

Although the temperature of the exciting coil as well as the temperature of the heat roller can be detected by way of temperature-detecting means 137, the information from this temperature-detecting means 137 may be directly fed to an IH (induction heating) circuit 138. Alternatively, the information from this temperature-detecting means 137 may be fed to a CPU 139 at first, and then, fed in the form of ON/OFF signals to the IH circuit 138.

The exciting coil of the fixing device according to this embodiment has the following characteristics.

Namely, in a state where the exciting coil is positioned inside the heat roller, the inductance (L) and resistance (R) of the exciting coil would be: L=27 ($\mu$H) and R=1.5 (Ω), provided that the driving frequency of the inverter circuit is 25 kHz.

Whereas in a state where the exciting coil is not positioned inside the heat roller, the inductance (L) and resistance (R) of the exciting coil would be: L=35 ($\mu$H) and R=0.1 (Ω). Namely, when the exciting coil is positioned inside the heat roller, the inductance (L) can be decreased while increasing the resistance (R) as compared with the case where the exciting coil is not positioned inside the heat roller.

This may be attributed to the fact that when the exciting coil is positioned inside the heat roller, a magnetic field acts on the heat roller, whereby a load is generated apparently as it is viewed in its primary side. In this case, a load corresponding to a resistance of 1.4 Ω is created thereby enabling eddy currents to generate in the heat roller, thus allowing Joule heat to be generated to a magnitude corresponding to this resistance. Due to this Joule heat generated in this manner, the heat roller is heated up to and maintained at a temperature of 180° C.

In this case, if the exciting coil is not constructed such that the ratio between the inductance L and the load resistance R meets a formula of: $L/R<50\times10^{-6}$ (H/Ω), it becomes no longer possible to confine the driving frequency of the inverter circuit to not less than 20 kHz in obtaining a desired quantity of heat which is absolutely required in the fixing device of this embodiment.

Namely, for the purpose of obtaining a high-frequency current output of 900 W, if the aforementioned formula is not met, the driving frequency would become less than 20 kHz, rendering the frequency to fall within the audible range, thus resulting in the generation of vibration or noise, and making it substantially impossible to utilize the exciting coil in the fixing device. Even if the circuit is driven with a separately excited vibration, it would be impossible to obtain an output of 900 W, i.e. the minimum quantity of heat required for the fixing.

As explained above, it has been found out by the present inventors as a result of the experiments conducted that even if the inductive heating means of the fixing device is operated at a driving frequency of not less than 20 kHz, it is impossible to obtain an output of 900 W or more unless the exciting coil is constructed to meet the condition of: $L/R<50\times10^{-6}$ (H/Ω).

In the foregoing description of the fixing device of the present invention, although the ratio (L/R) between the inductance L and load resistance R of the exciting coil has been explained as being an important parameter giving an important influence to the performance of the inductive heating means, there are still various parameters which may influence to the characteristics of the inductive heating member other than this L/R. The following is an explanation of such parameters.

(1) The exciting coil should satisfy the formula of: $V^2/[(2\pi fL)^2+R^2]^{-1/2}>600$ under conditions where a supply voltage of the inverter driving circuit is in the range of 100 to 250 V, and a frequency thereof is in the range of 20 to 50 kHz:

When the exciting coil is constructed to meet these conditions, it becomes possible to obtain a desired output (not less than 600 W) through an electric current passing through the circuit and coil by directly using the supply voltage without necessitating the amplification of electric current passing 4 through the exciting coil by means of a transformer, thereby making it possible to greatly reduce the manufacturing cost of the fixing device. Furthermore, since the number of switching elements to be employed in the driving circuit can be reduced to only one, the fixing device can be manufactured at low cost. As explained above, even if a core-less coil having no core bar therein is employed, it becomes possible to obtain a sufficient amount of heat.

Whereas, if the exciting coil fails to satisfy the aforementioned formula of: $V^2/[(2\pi fL)^2+R^2]^{1/2}>600$, the electric current passing through the switching element of inverter circuit would be required to be amplified by means of a transformer, etc. before feeding the electric current to the exciting coil. Namely, unless a transformer, etc. is employed, the quantity of electric current would become insufficient, thus making it impossible to obtain the required amount of heat.

Figure 5:
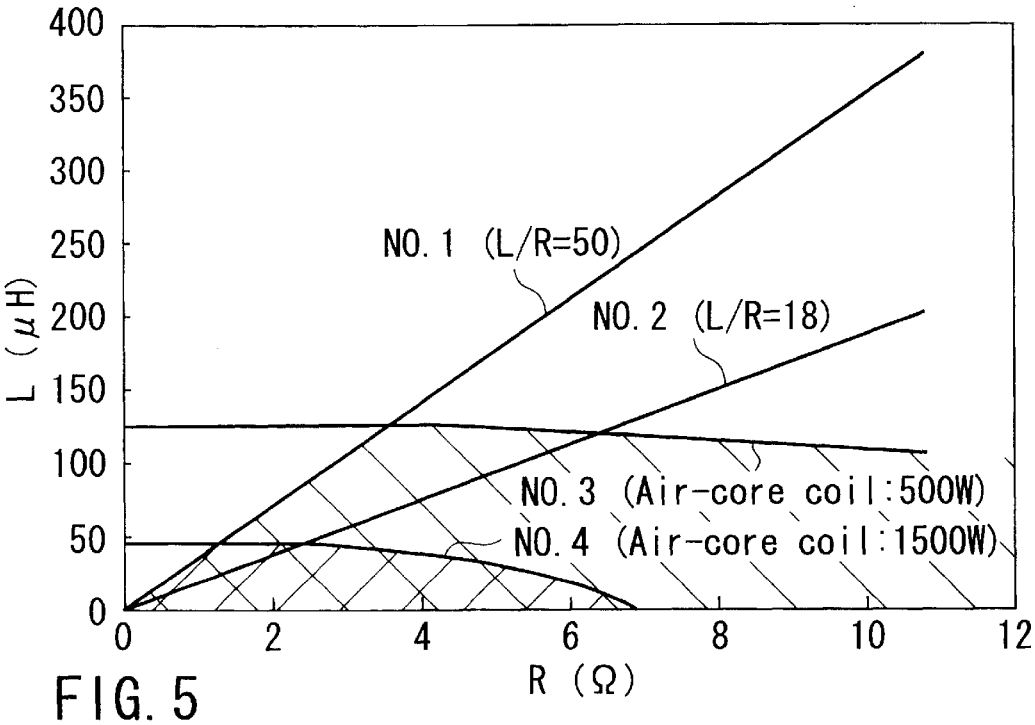
FIG. 5 is a graph illustrating the relationship between L and R in various kinds of exciting coil.

FIG. 5 shows the relationship between L and R in various kinds of exciting coil, wherein the ordinate represents the inductance (L), and the abscissa represents the resistance (R).

Next, the relationship of L/R will be explained with reference to FIG. 5.

Referring to FIG. 5, the relationship No. 1 denotes a formula of: $L/R=50\times10^{-6}$ (H/Ω) Since the exciting coil according to this embodiment exhibited a value of: $L/R=18\times10^{-6}$ (H/Ω), the relationship between these L and R thereof corresponds to the relationship No. 2 of the graph shown in FIG. 5, thereby meeting the formula of: $L/R<50\times10^{-6}$ (H/Ω).

Further, under the conditions where the supply voltage V is set to 100 V, and the frequency f is set to 25 kHz, it is required, for the purpose of obtaining an output of 600 W which is a minimum value absolutely required for the fixing device, to construct the coil in such a manner that the features of the coil fall within the region (the region shaded by oblique lines) which meets not only the region below the relationship No. 1 but also the region below the relationship No. 3.

Furthermore, if it is required to obtain an output of 900 W, the features of the coil should be within the region (the region shaded by crossed lines) which not only satisfies the region below the relationship No. 4 but also the region below the relationship No. 1.

Since the exciting coil according to this embodiment exhibited a value of: $L=27\times10^{-6}$ (HΩ) and a value of: R=1.5 (Ω), it satisfies the relationship of these L and R, thus making it possible to obtain a sufficient quantity of heat required for the fixing device. As explained above, according to this embodiment, it becomes possible to determine the configuration of the exciting coil which satisfies the aforementioned relationships.

(2) The exciting coil is constructed such that an electric current I which is represented by a formula of: $I=(V/R)(1-e^{-1/fL/R})$ meets a withstanding current of switching element of the inverter driving circuit under conditions where a supply voltage of the inverter driving circuit is in the range of 100 to 250 V, and a frequency thereof is in the range of 20 to 50 kHz:

If the exciting coil is constructed to meet the aforementioned conditions, the switching element can be prevented from being damaged.

(3) The thickness of the heat roller:

It is desired that the thickness of the heat roller is larger than the penetrating depth of the induction current. Since the eddy current generated in the heat roller by the effect of the exciting coil is permitted to flow only into the penetration depth thereof from the surface of the heat roller, it would be sufficient, for the purpose of effectively generating eddy currents, to make the thickness of the heat roller larger than the penetration depth. If the thickness of the heat roller is smaller than the penetration depth of the induction current, the magnitude of the eddy currents which are inherently expected to flow into the heat roller would not be obtained, thereby minimizing the quantity of heat to be generated.

However, if the thickness of the heat roller is too thick, the quantity of heat would become excessive, leading to the delay of the startup of the fixing device, thereby prolonging the warming-up time. On the other hand, a large quantity of heat would be required for obtaining a predetermined degree of temperature, and therefore, large electric currents are required to be passed into the exciting coil. In that case however, the magnitude of the electric field leak from the lead wire interposed between the exciting coil and the driving circuit would be excessively increased, thereby raising a problem in terms of regulations.

Therefore, for the purpose of shortening the startup time as well as for the purpose of minimizing the magnitude of the electric field leak, the thickness of the heat roller should be as thin as possible.

In view of the aforementioned circumstances, the thickness of the heat roller should preferably be in the range of 0.1 to 10 mm.

(4) The diameter of the heat roller:

The diameter of the heat roller should preferably be selected so as to meet the conditions that the exciting coil can be incorporated therein, and that the gap between the exciting coil and the heat roller would be confined within a predetermined range as described below.

(5) The gap between the exciting coil and the heat roller:

The gap between the exciting coil and the heat roller should preferably be 1 mm in order to prevent the exciting coil from being contacted with the inner wall of the heat roller, taking the working precision thereof into account. Namely, if the gap is too large, the electric current to be fed to the exciting coil would be required to be increased in order to obtain a desired quantity of heat. In that case however, the magnitude of the electric field leak from the lead wire interposed between the exciting coil and the driving circuit would be excessively increased, thereby raising a problem in terms of regulations.

In view of this, the gap between the exciting coil and the heat roller should preferably be confined within the range of from 1 mm to 4 mm.

(6) Frequency:

The frequency of high-frequency current to be fed to the exciting coil should preferably be within the range of 20 to 50 kHz. As mentioned above, if the frequency of high-frequency current becomes less than 20 kHz, it becomes an audio-frequency, thus resulting in the generation of vibration or noise, making it substantially impossible to apply the exciting coil to the fixing device. Further, in view of the restrictions imposed on the switching element, the employment of a frequency exceeding over 50 kHz would be difficult.

(7) Materials for the heat roller and the permeability of the materials:

As for the materials for constituting the heat roller they should preferably be selected from those having a permeability of not more than 200. Specific examples of such materials are iron, stainless steel, aluminum and a composite material consisting of stainless steal and aluminum.

Incidentally, when a material having a lower permeability is selected, the frequency of high-frequency current to be fed to the exciting coil can be decreased.

(8) Magnitude of electric field leak outside the fixing device:

The magnitude of electric field leak outside the fixing device is demanded by regulations to be not more than 500 $\mu$V/m at a distance of 3 m. Therefore, it is required, even in the fixing device of the present invention, to meet this requirement. For this purpose, the aforementioned various conditions such as the thickness of the heat roller, the gap between the exciting coil and the heat roller, etc. should be suitably selected so as to meet this requirement.

As explained above, according to the present invention, since the coil member is constructed such that in a state where the coil member is positioned in the fixing device, a ratio between the inductance L and the load resistance R of the coil member meets a condition of: $L/R<50\times10^{-6}$ (H/Ω), it becomes possible to provide a fixing device which makes it possible to perform a stable and effective heating, which can be cheaply manufactured, and which is capable of easily meeting the requirement stipulated by regulations with regard to the magnitude of electric field leak.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device comprising:

an endless heating member which is adapted to be contacted with a fixable member to thereby enable an image on the fixable member to be thermally fixed;

an electromagnetic inductive coil member disposed close to the endless heating member and inductively heating the endless heating member; and an AC power supply circuit supplying an AC current to said coil member, wherein said coil member is constructed such that in a state where said coil member is positioned in the fixing device, a ratio between an inductance L of said coil member and a load resistance R of said coil member meets a condition of: $L/R<50\times10^{-6}$ (H/Ω), and wherein said coil member comprises a non-magnetic coil-supporting member, and a coil supported by said non-magnetic coil-supporting member.

2. The fixing device according to claim 1, wherein said AC power supply circuit comprises an inverter driving circuit.

3. The fixing device according to claim 1, wherein said endless heating member has a thickness ranging from 0.1 to 10 mm.

4. The fixing device according to claim 1, wherein said endless heating member is cylindrical having a diameter ranging from 20 to 60 mm.

5. The fixing device according to claim 1, wherein a gap between said endless heating member and said coil member is in the range of 1 to 4 mm.

6. The fixing device according to claim 1, wherein said AC current has a frequency ranging from 20 to 50 kHz.

7. The fixing device according to claim 1, wherein said endless heating member is constituted by a material having a relative magnetic permeability of not more than 200.

8. The fixing device according to claim 1, wherein said endless heating member comprises material selected from the group consisting of iron, stainless steel, aluminum and a composite material consisting of stainless steal and aluminum.

9. The fixing device according to claim 1, wherein said non-magnetic coil-supporting member is formed of a heat-resistant resin.

10. A fixing device comprising an endless heating member which is adapted to be contacted with a fixable member to thereby enable an image on the fixable member to be thermally fixed; an electromagnetic inductive coil member disposed close to the endless heating member and inductively heating the endless heating member; and an inverter driving circuit supplying an AC current to the electromagnetic inductive coil member; wherein said coil member is constructed such that in a state where said coil member is positioned in the fixing device, a ratio between an inductance L of said coil member and a load resistance R of said coil member meets a formula of: $L/R<50\times10^{-6}$ (H/Ω), and said inductance L and said load resistance R meet a formula of: $V^2/[(2\pi fL)^2+R^2]^{-1/2}>600$ under conditions where a supply voltage of the inverter driving circuit is in the range of 100 to 250 V, and a frequency thereof is in the range of 20 to 50 kHz.

11. The fixing device according to claim 10, wherein said coil member is constructed such that an electric current I which is represented by a formula of: $I=(V/R)(1-e^{-1/f/L/R})$ meets a withstanding current of switching element of the inverter driving circuit under conditions where a supply voltage of the inverter driving circuit is in the range of 100 to 250 V, and a frequency thereof is in the range of 20 to 50 kHz.

12. The fixing device according to claim 10, wherein said endless heating member has a thickness ranging from 0.1 to 10 mm.

13. The fixing device according to claim 10, wherein said endless heating member is cylindrical having a diameter ranging from 20 to 60 mm.

14. The fixing device according to claim 10, wherein a gap between said endless heating member and said coil member is in the range of 1 to 4 mm.

15. The fixing device according to claim 10, wherein said AC current has a frequency ranging from 20 to 50 kHz.

16. The fixing device according to claim 10, wherein said endless heating member is constituted by a material having a relative magnetic permeability of not more than 200.

17. The fixing device according to claim 10, wherein said endless heating member comprises a material selected from the group consisting of iron, stainless steel, aluminum and a composite material consisting of stainless steal and aluminum.

* * * * *